US007360490B2

(12) United States Patent
Kautzsch et al.

(10) Patent No.: US 7,360,490 B2
(45) Date of Patent: Apr. 22, 2008

(54) SPIN-STABILIZED ARTILLERY PROJECTILE

(75) Inventors: Karl Kautzsch, Schwanstetten (DE); Albrecht Reindler, Weissenohe (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 0 days.

(21) Appl. No.: 11/586,907

(22) Filed: Oct. 26, 2006

(65) Prior Publication Data

US 2007/0095238 A1 May 3, 2007

(30) Foreign Application Priority Data

Nov. 3, 2005 (DE) ..... 10 2005 052 474

(51) Int. Cl.
*F42B 10/26* (2006.01)
*F42B 10/50* (2006.01)
*F42B 10/54* (2006.01)

(52) U.S. Cl. ..... 102/473; 244/3.23

(58) Field of Classification Search ..... 102/473; 244/3.23, 3.24

See application file for complete search history.

(56) References Cited

U.S. PATENT DOCUMENTS 5,054,712 A 10/1991 Bar et al.
5,456,429 A 10/1995 Mayersak
5,647,558 A * 7/1997 Linick ..... 244/3.11
6,467,721 B1 10/2002 Kautzsch et al.
6,672,536 B2 * 1/2004 Bar et al. ..... 244/3.27
7,121,210 B2 * 10/2006 Steele ..... 102/211
2003/0042356 A1 3/2003 Bar et al.
2005/0258308 A1 11/2005 Bar et al.

FOREIGN PATENT DOCUMENTS

DE 28 09 281 C2 3/1978
DE 38 12 588 A1 4/1988
DE 40 36 166 A1 11/1990
DE 101 43 312 C1 9/2001
DE 102 42 588 A1 3/2004
EP 1 103 779 A1 11/2000

* cited by examiner

*Primary Examiner*—James S Bergin
(74) *Attorney, Agent, or Firm*—Scully, Scott, Murphy & Presser, P.C.

(57) ABSTRACT

A spin-stabilized artillery projectile (10) with a brake device (16) for reduction of the longitudinal deviation of the artillery projectile (10) in a target area (26) that has a number of impulse elements (24) distributed around its circumference that are provided to reduce the lateral deviation of the artillery projectile (10) in the target area (26) and thus improve the accuracy of aim.

14 Claims, 4 Drawing Sheets

SPIN-STABILIZED ARTILLERY PROJECTILE

BACKGROUND OF THE INVENTION

1. Field of the Invention

The invention relates to a spin-stabilized artillery projectile having a projectile detonator located in the projectile ogive, and a radially deployed brake device in the ogive for a reduction in the longitudinal deviation of the projectile in a target area.

2. Discussion of the Prior Art

A spin-stabilized artillery projectile of this kind is known from DE 101 43 312 C1 and DE 102 42 588 B4. This artillery projectile has a radially deployed brake device in its ogive that serves to reduce the longitudinal deviation of the artillery projectile in its target area. A 1D-correction is thus possible.

The deviation area of an artillery projectile in a target area is ellipsoidal, i.e. it has a longitudinal axis and a lateral axis orthogonal to it. The longitudinal axis, i.e. the longitudinal deviation is greater than the lateral axis, i.e. the lateral deviation. The brake device of the known spin-stabilized artillery projectile serves to reduce the large longitudinal deviation of the artillery projectile in the target area compared to the lateral deviation and thus correspondingly improves the accuracy of aim.

SUMMARY OF THE INVENTION

The object of the invention is to provide a spin-stabilized artillery projectile of the type named in the introduction, by means of which the lateral deviation of the artillery projectile in the target area can also be reduced by simple means and the accuracy of aim thus correspondingly improved.

The object is achieved according to the invention by the features, as described herein, also setting forth preferred embodiments or developments of the trajectory-corrected, spin-stabilized artillery projectile.

Because with the spin-stabilized artillery projectile according to the invention a number of impulse elements are provided distributed around the circumference, it is possible to effect a reduction in the lateral deviation of the artillery projectile in the target area by a suitable activation of at least one corresponding impulse element. By means of the artillery projectile according to the invention, a reduction in the lateral deviation of the artillery projectile in the target area is also realized in addition to a reduction in the longitudinal deviation and the accuracy of aim in the target area is substantially improved in a relatively simple manner. In this case, it is advantageous if the impulse elements are evenly distributed around the circumference of the artillery projectile because it is then comparatively simple to control the respective appropriate impulse element.

With the spin-stabilized artillery projectile according to the invention, the impulse elements can be provided in the ogive of the artillery projectile. With an embodiment of this kind, the impulse elements can be formed by the pyrotechnical force elements assigned to a front ring area of a shroud covering the brake device, and by means of which the shroud can be blown off from the ogive of the artillery projectile. Impulse elements of this kind in the form of pyrotechnical force elements are described in DE 101 43 312 C1, cited in the discussion of the prior art.

A further possibility exists in that the impulse elements are provided on a ring element arranged between the projectile detonator and the projectile casing. An embodiment of this latter kind also has the advantage that the artillery projectile can be combined, unmodified so to speak, with a known projectile detonator.

Especially with artillery projectiles with a large range, it can be advantageous if the impulse elements are provided in the tail section, i.e. in the base bleed, of the artillery projectile.

To determine the angle of rotation position of the artillery projectile at a particular time and therefore of the impulse elements distributed around its circumference, a device is used that interacts with the impulse elements for their appropriate activation. This device can be provided in the artillery projectile so that an autonomous device and an autonomous artillery projectile results. A different possibility is that this device can be controlled with the aid of a satellite. A satellite-aided control of a trajectory-corrected, spin-stabilized artillery projectile of the type named in the introduction, i.e. for reducing the longitudinal deviation of the artillery projectile in the target area is described in EP 1 103 779 B1, the disclosure content of which relates to the appropriate activation of the impulse elements provided around the circumference of the artillery projectile to reduce the lateral deviation in the target area, is part of this invention.

The trajectory-corrected, spin-stabilized artillery projectile has the advantage that by structurally simple means a reduction in the lateral deviation of the artillery projectile in a target area is realized in addition to a reduction in the longitudinal deviation. Furthermore, the reduction in the lateral deviation, i.e. the controlled lateral correction of the artillery projectile, is carried out an interval before the activation of the brake device to reduce the longitudinal deviation of the artillery projectile in the target area, because the lateral correction takes place faster than it takes for the brake device to effect a reduction in the longitudinal deviation.

Whereas with the known spin-stabilized artillery projectile a reduction in the longitudinal deviation, i.e. a 1D-correction results, the artillery projectile according to the invention provides a 1.5D-correction.

BRIEF DESCRIPTION OF THE DRAWINGS

Further details, features and advantages are given in the following description of two exemplary embodiments of the spin-stabilized artillery projectile and its operation, and are explained in the drawings; wherein.

DETAILED DESCRIPTION OF THE INVENTION

Figure 1:
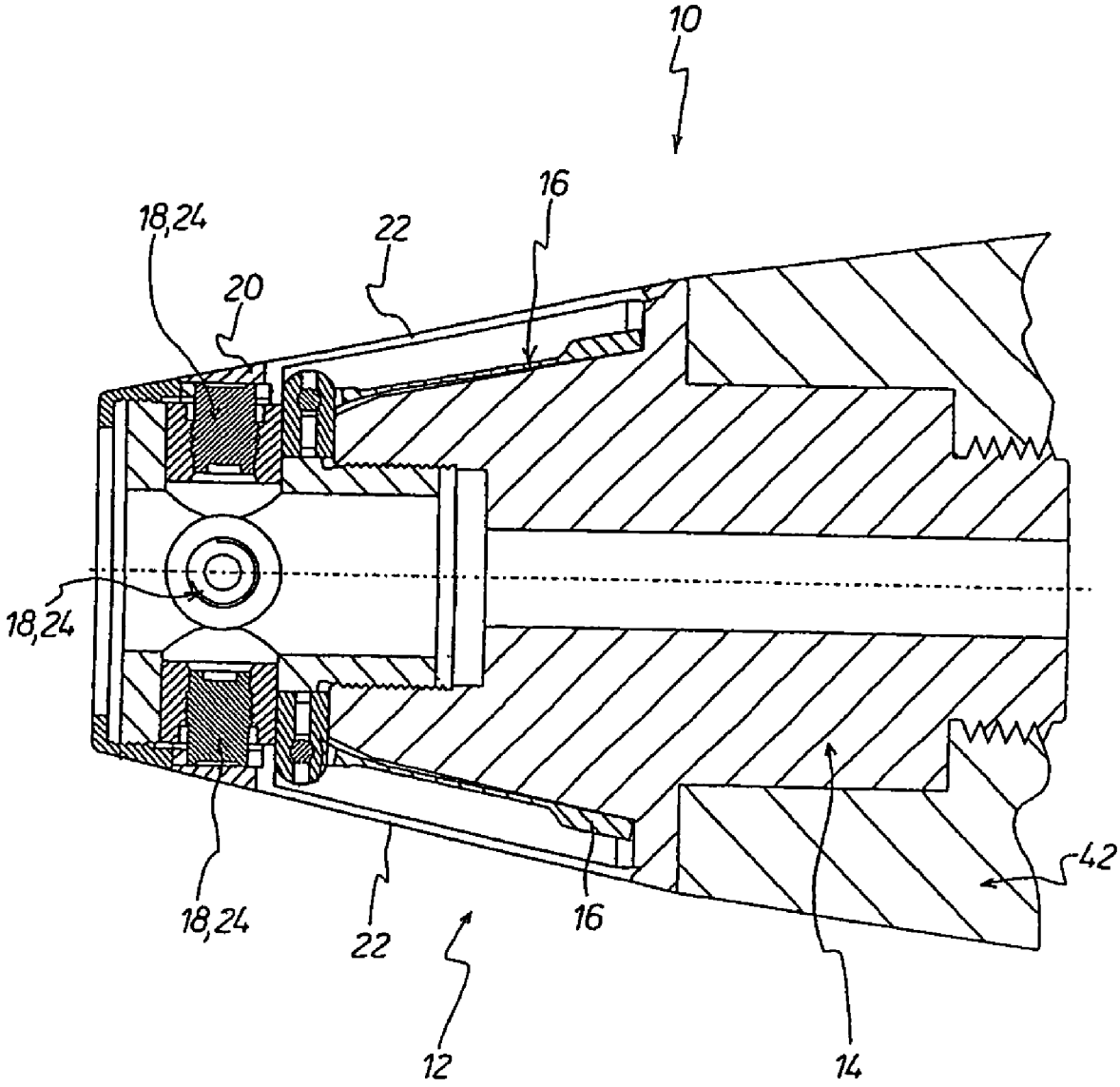
FIG. 1 illustrates a lengthwise section of a first embodiment of the artillery projectile.

FIG. 1 shows a lengthwise section of the front part of an embodiment of the spin-stabilized artillery projectile 10 with a projectile detonator 14 provided in its ogive 12 and a brake device 16 provided in the ogive 12 that, depending on centrifugal force, can be deployed by pyrotechnical force elements 18 assigned to a front ring area 20 of a shroud 22.

The pyrotechnical force elements 18 form the impulse elements 24 of the artillery projectile 10 evenly distributed around the circumference of the artillery projectile 10.

Figure 3:
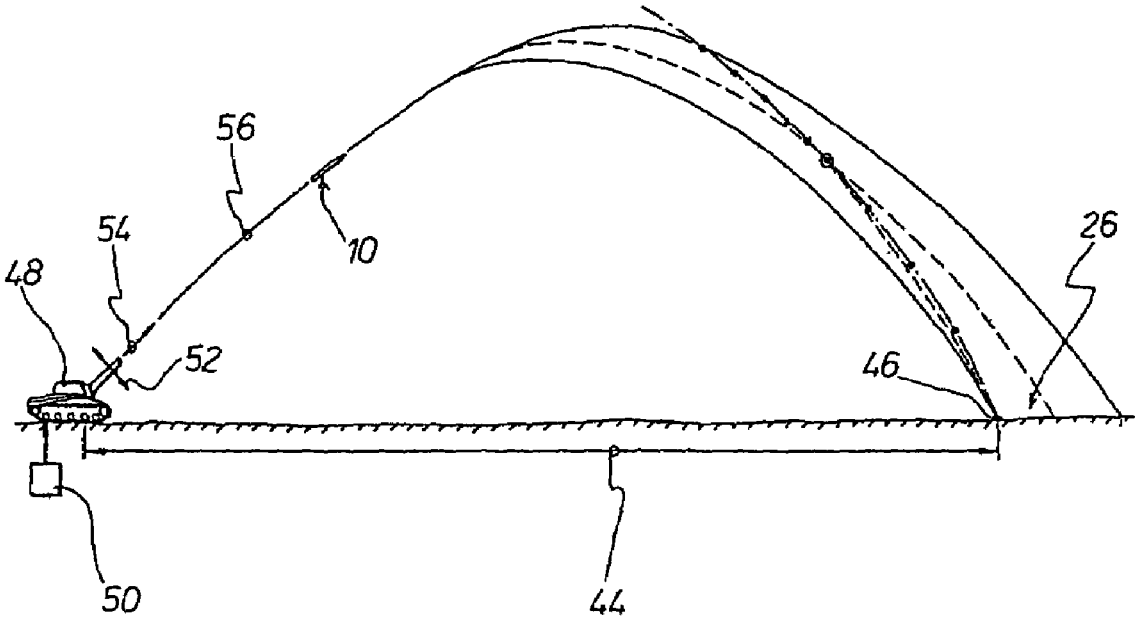
FIG. 3 illustrates the transfer of a ballistically launched, spin-stabilized artillery projectile from a gun to a target area.
Figure 4:
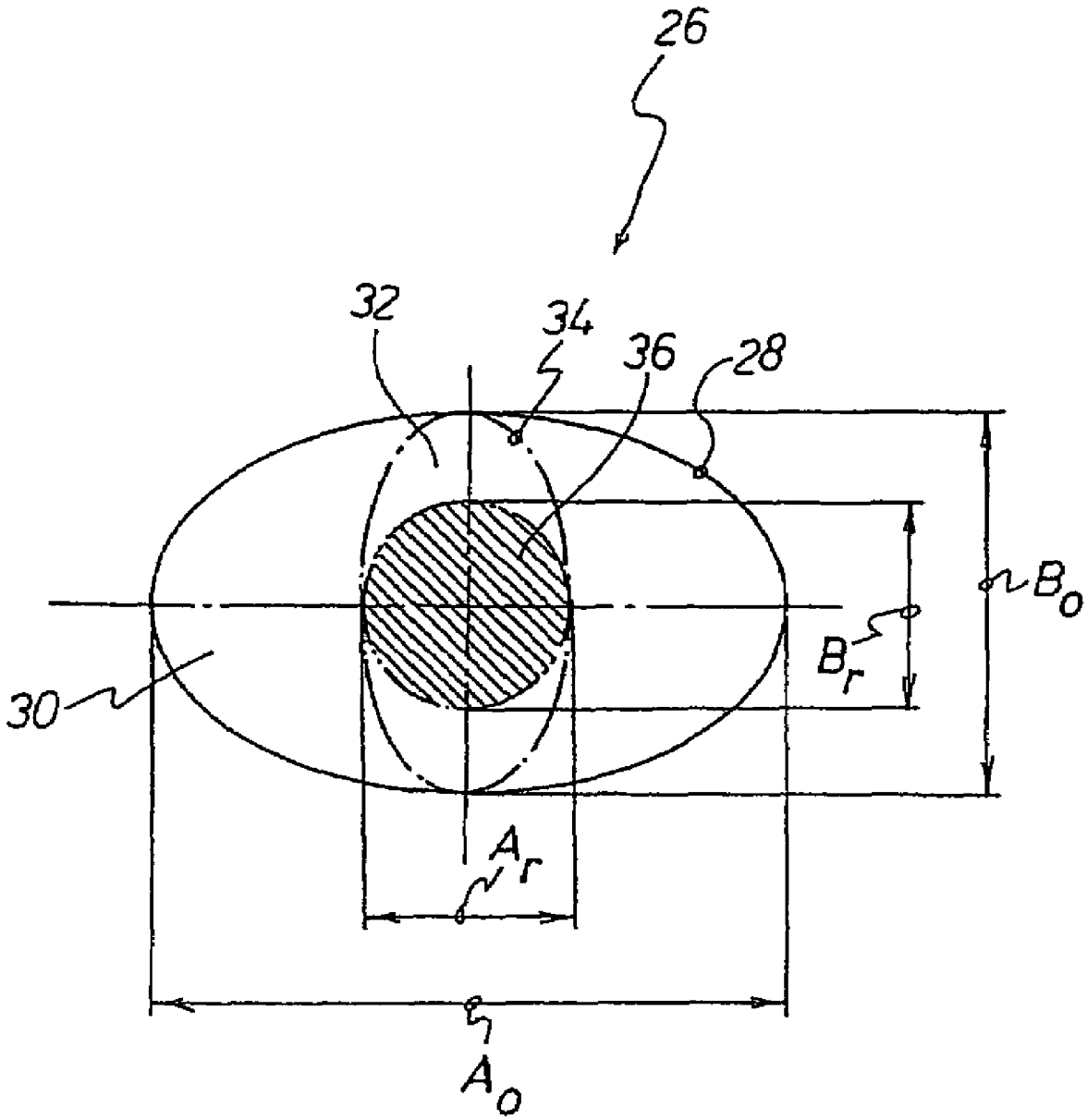
FIG. 4 illustrates a plan view of a target area with both the longitudinal deviation in the x-direction and the lateral deviation in the y-direction being reduced and the accuracy of aim subsequently correspondingly improved.

The brake device 16 serves to reduce the longitudinal deviation of the artillery projectile 10 in the target area (see FIGS. 3 and 4). The target area 26 shown in FIG. 4 is ellipsoidal, i.e. is represented by an elliptical boundary 28. The deviation area 30 bounded by the elliptical boundary 28 has a longitudinal axis $A_0$ and a lateral axis $B_0$. The brake device 16 produces a reduction in the longitudinal deviation, i.e. in the longitudinal axis $A_0$ of an amount $A_r$. A reduction in the lateral axis $B_0$ is not produced by the brake device 16 of the artillery projectile 10, i.e. the deviation area 30 is reduced by the brake device 16 to a deviation area 32 bounded by the boundary line 34.

With the aid of the impulse elements 24 distributed around the circumference of the artillery projectile 10, a reduction in the lateral deviation of the artillery projectile 10 results due to suitable activation of the corresponding impulse elements 24 on an artillery projectile 10 with a brake device 16, i.e. a further reduction in the deviation area 32 to a deviation area 36 bounded by the boundary line 38. The deviation area 36 in the x-direction is determined by the longitudinal dimension $A_r$ and in the y-direction by the lateral dimension $B_r$, with it being preferred that $A_r$ and $B_r$ be equal, so that a circular deviation area 36 results.

For further details of the artillery projectile 10 according to FIG. 1 refer to DE 101 43 312 C1, cited in the introduction, DE 102 42 588 B4, which is a patent of addition with respect to DE 101 43 312 C1, wherein the disclosures of both of these publications are incorporated herein by reference in their entireties.

Figure 2:
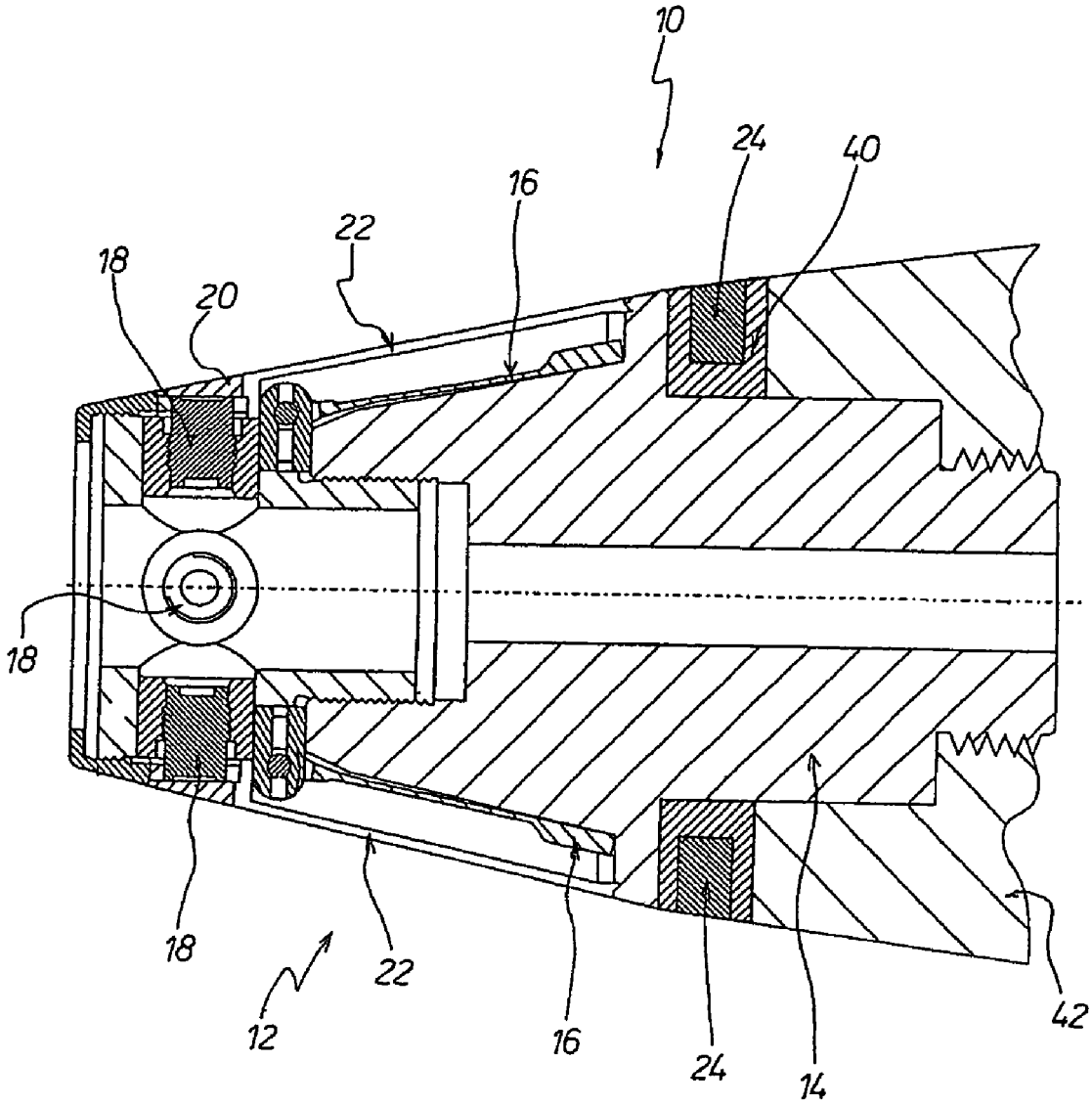
FIG. 2 illustrates, in a view similar to FIG. 1, a second embodiment of the artillery projectile.

FIG. 2 shows an embodiment of the artillery projectile 10 in a lengthwise section drawing showing a similar section to that in FIG. 1, with the impulse elements 24 being provided, arranged equally spaced, in the circumferential direction around a ring element 40 that is arranged between the projectile detonator 14 and the projectile casing 42. The pyrotechnical force elements 18 in this embodiment of the artillery projectile 10 are used only to blow off the shroud 22 covering the brake device 16.

Especially with artillery projectiles 10 with a long range 44 (see FIG. 3) between the target 46 and the gun 48 from which the artillery projectile 10 is fired, the impulse elements can be provided in the tail section (base bleed) of the artillery projectile 10 evenly distributed in the circumferential direction.

FIG. 3 shows a fire control computer with the reference character 50. From the predetermined direction and distance 44 from the gun 48 to the target 46 the fire control computer 50 determines the azimuth direction, the elevation shown by the double arrow 52 and the propellant power, i.e. the theoretical exit velocity 54 for the ballistic trajectory 56 of the artillery projectile 10 to the target area 26.

With regard to the reduction of the longitudinal deviation of the artillery projectile and the corresponding method for target-related correction of the ballistic trajectory refer to EP 1 103 779 B1 cited in the introduction, the disclosure of which is incorporated herein by reference in its entirety.

REFERENCE CHARACTER LIST

10 Artillery projectile
12 Ogive (of 10)
14 Projectile detonator (in 12)
16 Brake device (of 10)
18 Pyrotechnical force element (for 20)
20 Front ring area (of 22)
22 Shroud (for 16)
24 Impulse elements (of 10)
26 Target area (of 10 at 46)
27 second end portion (of 24 @ 18)
28 Elliptical boundary (of 30)
30 Deviation area
32 1D-reduced deviation area
34 Boundary line (of 32)
36 1.5D-reduced deviation area
38 Boundary line (of 36)
40 Ring element (between 14 and 42 for 24)
42 Projectile casing (of 10)
44 Range (of 10 between 48 and 46)
46 Target
48 Gun (for 10)
50 Fire command computer (for 48)
52 Double arrow/elevation (of 48)
54 Exit velocity (of 10)
56 Ballistic trajectory (of 10 between 48 and 26)

What is claimed is:

1. A spin-stabilized artillery projectile with a projectile detonator (14) provided in an ogive (12) of the projectile, and a radially deployed brake device (16) provided in the ogive (12) for reduction of the longitudinal deviation ($A_0$; $A_r$) of the artillery projectile (10) in a target area (26), (a) wherein the artillery projectile (10) has a number of impulse elements (18, 24) comprising pyrotechnic force elements distributed around the circumference thereof in order to reduce a lateral deviation ($B_0$; $B_r$) of the artillery projectile (10) in a target, and (b) wherein at least one said impulse element (18) correlated for the reduction of the lateral deviation ($B_0$; $B_r$) is controllably activatable through a device which is in operative association with said impulse elements (18, 24), through which device there is determinable the presently timewise rotationally angular position of the artillery projective and thereby the mutually spaced impulse elements (18, 24) in the circumferential direction.

2. An artillery projectile according to claim 1, wherein the impulse elements (24) are evenly distributed around the circumference of the artillery projectile.

3. An artillery projectile according to claim 1, wherein the impulse elements (24) are located in the ogive (12) of the artillery projectile (10).

4. An artillery projectile according to claim 3, wherein the pyrotechnic force elements (18) are operatively associated with a front ring area (20) of a shroud (22) covering the brake device (16), and through the intermediary of said pyrotechnic force elements providing a capability to blow the shroud (22) off the ogive (12) of the artillery projectile (10).

5. An artillery projectile according to claim 3, wherein further of the impulse elements (24) are arranged on a ring element (40), which is located between the projectile detonator (14) and a projectile casing (42).

6. An artillery projectile according to claim 1, wherein the impulse elements (24) are located in the tail section or base bleed of the artillery projectile (10).

7. An artillery projectile according to claim 1, wherein the device is provided in the artillery projectile (10).

8. An artillery projectile according to claim 1, wherein the device is controlled with the aid of a satellite.

9. A spin-stabilized artillery projectile with a projectile detonator (14) provided in an ogive (12) of the projectile, and a radially deployed brake device (16) provided in the ogive (12) for reduction of the longitudinal deviation ($A_0$; $A_r$) of the artillery projectile (10) in a target area (26), wherein the artillery projectile (10) has a number of impulse elements (24) consisting of pyrotechnic force elements (18) distributed around the circumference thereof in order to reduce a lateral deviation ($B_0$; $B_r$) of the artillery projectile (10) in a target, and (a) wherein the artillery projectile (10) has a number of said impulse elements (24) comprising pyrotechnic force elements (18) distributed around the circumference thereof in order to reduce a lateral deviation ($B_0$; $B_r$) of the artillery projectile (10) in a target, and (b) wherein at least one said impulse element (24) correlated for the reduction of the lateral deviation ($B_0$; $B_r$) is controllably activatable through a device which is in operative association with said impulse elements (18, 24), through which device there is determinable the presently timewise rotationally angular position of the artillery projective and thereby the mutually spaced impulse elements (24) in the circumferential direction, and (c) wherein further said impulse elements (24) are arranged on a ring element (40) which is located between the projectile detonator (14) and a projectile casing (42).

10. An artillery projectile according to claim 9, wherein the pyrotechnic force elements (18, 24) are evenly distributed around the circumference of the artillery projectile.

11. An artillery projectile according to claim 9, wherein the pyrotechnic force elements (18, 24) are located in the ogive (12) of the artillery projectile (10).

12. An artillery projectile according to claim 11, wherein the pyrotechnic force elements (18) are operationally associated with a front ring area (20) of a shroud (22) covering the brake device (16), said pyrotechnic force elements (18) possessing the capability of blowing the shroud (22) off the ogive (12) of the artillery projectile (10).

13. An artillery projectile according to claim 9, wherein the device is provided in the artillery projectile (10).

14. An artillery projectile according to claim 9, wherein the device is controlled with the aid of a satellite.

* * * * *